US008641357B2

(12) United States Patent
Johnson

(10) Patent No.: US 8,641,357 B2
(45) Date of Patent: Feb. 4, 2014

(54) TRACK HOE ATTACHMENT TO LOAD AND UNLOAD PIPE

(76) Inventor: Charles David Johnson, Quitman, AR (US)

( * ) Notice: Subject to any disclaimer, the term of this patent is extended or adjusted under 35 U.S.C. 154(b) by 811 days.

(21) Appl. No.: 12/880,245

(22) Filed: Sep. 13, 2010

(65) Prior Publication Data

US 2011/0085881 A1 Apr. 14, 2011

Related U.S. Application Data

(60) Provisional application No. 61/250,614, filed on Oct. 12, 2009.

(51) Int. Cl.
*E02F 9/00* (2006.01)
*B66C 1/00* (2006.01)
*B66F 9/18* (2006.01)

(52) U.S. Cl.
USPC ..... 414/724; 414/607; 414/785; 414/911; 414/912; 37/405; 37/443

(58) Field of Classification Search
USPC ..... 414/722, 724, 607, 785, 911, 912; 37/405, 443, 444
See application file for complete search history.

(56) References Cited

U.S. PATENT DOCUMENTS 2,516,364 A 6/1950 Caddell
2,698,698 A 1/1955 Smith et al.
3,384,255 A 5/1968 Hickman
3,438,655 A * 4/1969 Campbell ..... 285/143.1
3,472,402 A 10/1969 Priefert
3,667,633 A * 6/1972 Cappella ..... 414/724
3,706,388 A 12/1972 Westendorf
3,710,472 A 1/1973 Gremillion et al.
3,732,996 A 5/1973 Bauer
3,908,844 A * 9/1975 Duffield ..... 414/724
4,242,035 A 12/1980 Hornstein
4,264,264 A 4/1981 McMillan et al.
4,275,985 A 6/1981 Schremmer
4,360,980 A 11/1982 Jarvis
4,492,399 A 1/1985 Randen et al.
4,521,980 A * 6/1985 Solaja ..... 37/404
4,560,318 A 12/1985 Rodgers et al.
4,690,609 A 9/1987 Brown
4,692,089 A 9/1987 Rodgers et al.
4,707,013 A 11/1987 Vranish et al.
4,708,576 A * 11/1987 Conley ..... 414/607
4,790,084 A 12/1988 Anderson et al.
4,810,160 A 3/1989 Emiliani et al.
4,813,142 A 3/1989 Manno
4,848,012 A 7/1989 Zimmerman
4,999,022 A 3/1991 Veys
5,007,794 A 4/1991 Lombard
5,054,989 A 10/1991 Fell
5,116,189 A 5/1992 Shammout
5,144,761 A 9/1992 Fitzwater
5,163,804 A 11/1992 Kobayashi (Continued)

*Primary Examiner* — Scott Lowe
(74) *Attorney, Agent, or Firm* — Richard Blakely Glasgow

(57) ABSTRACT

A track hoe bucket attachment for purposes of loading and unloading pipe comprising two tines connected at one end by a pipe. The pipe has an opening that is capable of receiving the teeth of the track hoe bucket. The two tines are further connected by a support bar which has eyelets at its two ends. The eyelets of the support bar receive a chain that is connected to the track hoe to further secure the attachment to the track hoe.

9 Claims, 2 Drawing Sheets

(56) References Cited

U.S. PATENT DOCUMENTS

| | | | | |
|---|---|---|---|---|
| 5,215,425 | A | 6/1993 | Hambright | |
| 5,518,359 | A | 5/1996 | Pratt | |
| 5,639,205 | A | 6/1997 | Kaczmarczyk et al. | |
| 5,746,564 | A | 5/1998 | McPherson | |
| 6,425,727 | B1 | 7/2002 | Hood | |
| 6,527,497 | B2 * | 3/2003 | Perry | 414/724 |
| 6,655,054 | B1 | 12/2003 | Ward | |
| 6,701,630 | B2 * | 3/2004 | Humphrey | 37/403 |
| 6,718,662 | B1 | 4/2004 | Schaff | |
| 6,886,279 | B2 | 5/2005 | Kimble | |
| 6,988,866 | B2 * | 1/2006 | Friedland et al. | 414/724 |
| 6,990,758 | B1 | 1/2006 | Holmes et al. | |
| 7,018,164 | B2 | 3/2006 | Anthis et al. | |
| 7,125,082 | B2 | 10/2006 | Copus | |
| 7,354,239 | B2 | 4/2008 | Deyo et al. | |
| 7,670,098 | B2 | 3/2010 | Caughern | |
| 2002/0100193 | A1 | 8/2002 | Larsen | |
| 2004/0253089 | A1 * | 12/2004 | Atencio | 414/724 |

* cited by examiner

TRACK HOE ATTACHMENT TO LOAD AND UNLOAD PIPE

CROSS-REFERENCE TO RELATED APPLICATIONS

This application claims the benefit of U.S. Provisional Application No. 61/250,614, entitled "Track hoe attachment to load and unload pipe" and filed Oct. 12, 2009. The complete disclosure of said provisional patent application is hereby incorporated by reference.

STATEMENT REGARDING FEDERALLY SPONSORED RESEARCH OR DEVELOPMENT

Not applicable

BACKGROUND OF THE INVENTION

1. Field of the Invention

The present invention relates to attachments for track hoe vehicles, and in particular, to a track hoe attachment to load and unload pipe.

2. Description of the Related Art

Attachments to the buckets of construction equipment for purposes of loading and unloading materials are well-known in the art. For example, U.S. Pat. No. 4,692,089 to Rodgers et. al. teaches an attachment that is bolted to the back of the bucket comprising two arms. In addition, U.S. Pat. No. 4,242,035 to Hornstein teaches an attachment to a loader bucket for purposes of serving as a pallet loader or fork lift comprising two tines and two chains that connect the tines to the bucket. The prior art attachments are often complex in design and not easily attachable and detachable.

It would therefore be desirable to develop an attachment for a track hoe vehicle for purposes of loading and unloading pipe that is simple in design, and thus easier to manufacture, and that is easily attachable and detachable.

BRIEF SUMMARY OF THE INVENTION

The present invention is directed to a track hoe bucket attachment which may be employed to load and unload pipe and other materials.

In the preferred embodiment, the invention is directed to a track hoe attachment comprising two tines connected at one end by a pipe that is capable of receiving the teeth of the track hoe bucket. The two tines are further connected by a support bar which has eyelets at its two ends. The eyelets of the support bar receive a chain that is connected to the track hoe to further secure the attachment to the track hoe.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
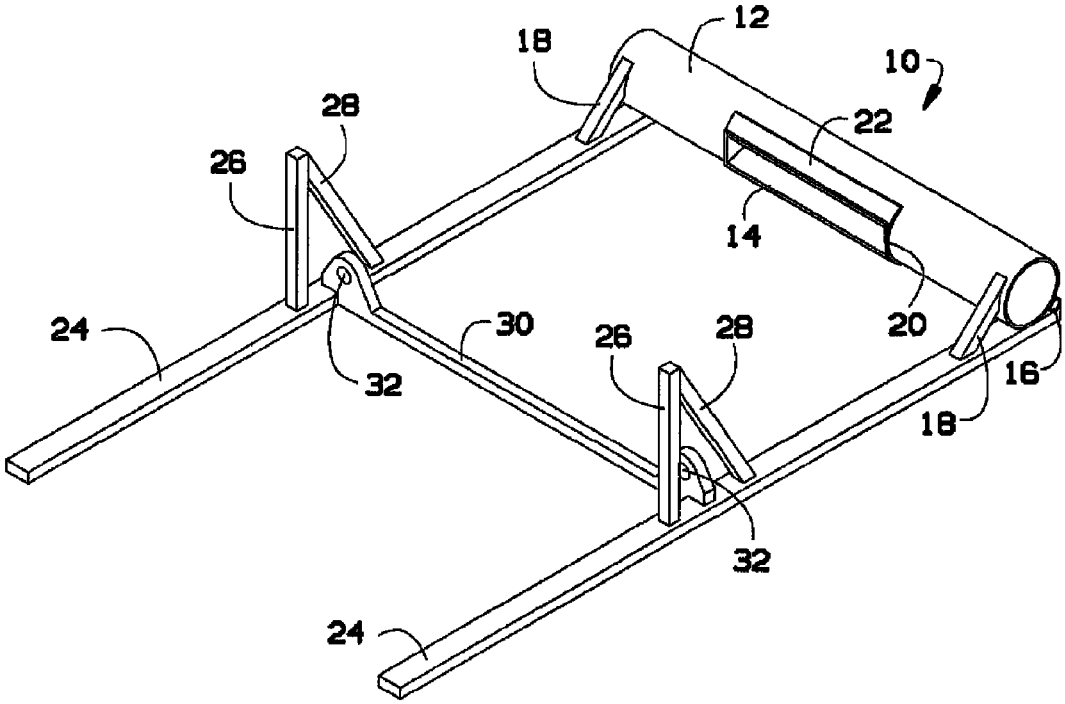
FIG. 1 is a perspective view of the preferred embodiment of the present invention.
Figure 2:
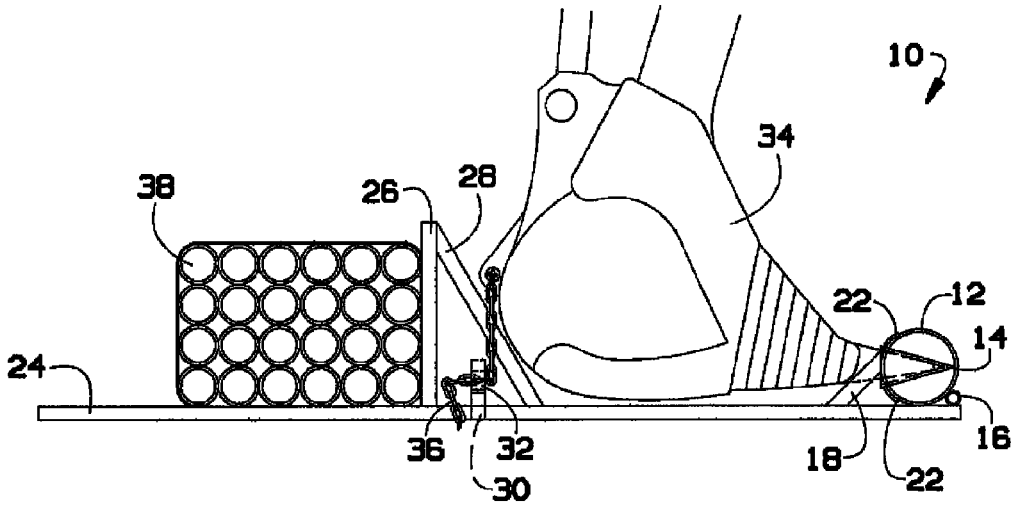
FIG. 2 is a side elevational view of the preferred embodiment of the present invention.
Figure 3:
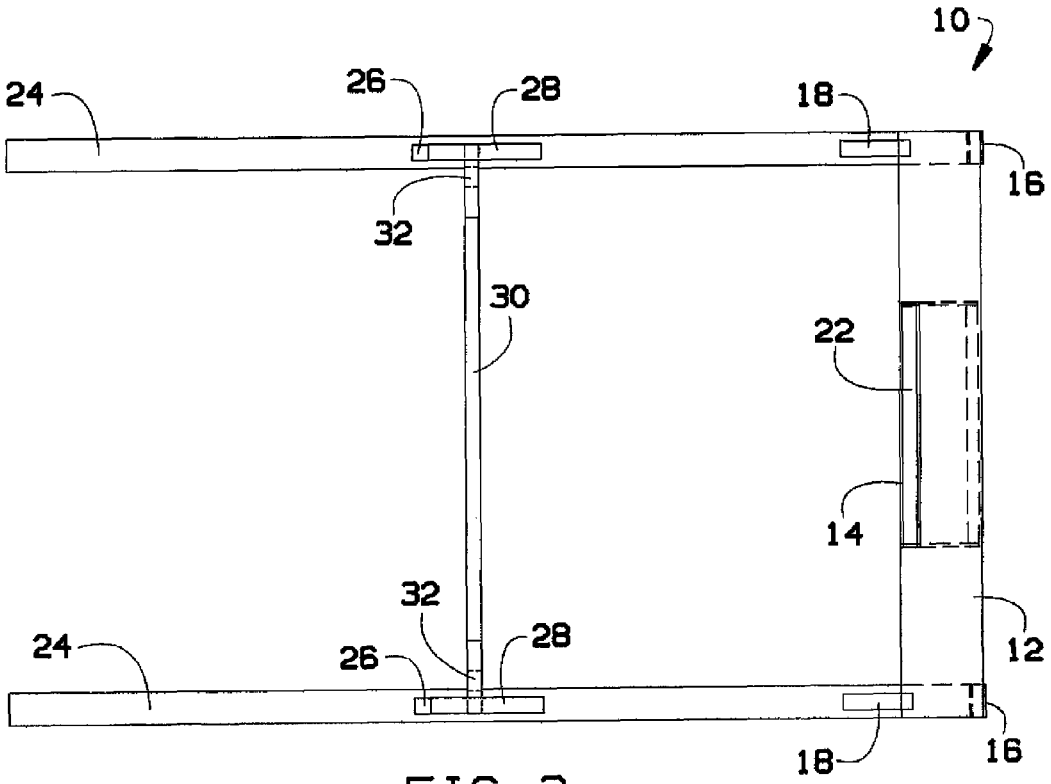
FIG. 3 is a top elevational view of the preferred embodiment of the present invention.
Figure 4:
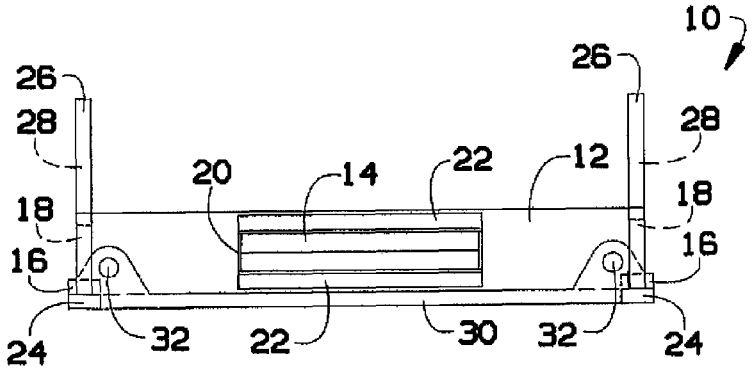
FIG. 4 is a front elevational view of the preferred embodiment of the present invention.

With reference to FIGS. 1-4, the preferred embodiment of the present invention may be described. The track hoe attachment 10 is comprised of two tines 24. The two tines 24 have a first end and a second end. The tines 24 are tapered at their second end. The tines 24 are preferably made of spring steel and measure 1.75 inches in height, 4 inches in width, and 10 feet in length. The two tines 24 are parallel to one another and are connected by pipe 12 at their first end and support bar 30 between their first and second ends.

Support bar 30 is preferably made from A120 steel that has a minimum tensile strength of 45,000 pounds per square inch. It is preferably 1.75 inches in width, 4 inches in height, and 6 feet in length. The support bar 30 has rounded segments on each end. Each rounded segment is preferably 8 inches in height and 12 inches wide. The length of the support bar 30 between the rounded segments is four feet. The support bar 30 is also notched on the exterior bottom ends to receive tines 24. The bottom of the tines 24 and the bottom of the support bar 30 are flush. Tines 24 and support bar 30 are preferably wielded together. The rounded segments of the support bar 30 have eyelets 32. The diameter of the eyelet is preferably two inches.

Tines 24 are vertically intersected by stop bars 26. The stop bars 26 are wielded to the tines 24 and are preferably made from grade A120 steel. They preferably measure 2 inches in length, 2 inches in width, and 24 inches in height. The stop bars 26 are preferably wielded 48-50 inches from the second end of the tines 24. In an alternative embodiment, the stop bars 26 are slidable along tines 24 and adjustable by height.

Stop bar braces 28 are wielded to the top surface of the tines 24 and at less than a 90 degree angle to the top side of stop bars 26. The stop bar braces 28 are preferably made of A120 steel. The stop bars 26 and stop bar braces 28 are the same size.

The two tines 24 are also connected at their first ends by pipe 12. The pipe 12 is preferably made of grade A120 steel. While the pipe 12 is cylindrical in shape in the preferred embodiment, it could be rectangular or any other suitable shape. In the preferred embodiment, the diameter of the pipe 12 is ten inches and the length of the pipe 12 is six feet, however, the dimensions of the pipe will vary depending on the size of bucket 34. When attached to tines 24, pipe 12 has a front surface and a back surface. The front surface faces support bar 30. The pipe 12 has a rectangular opening 20 in its front surface which receives insert 14. In the preferred embodiment, the opening 20 is 34 inches in length and five inches in height. The dimensions of the opening 20 will also vary depending on the size of the bucket 34. Insert 14 is preferably made of grade A120 steel. Insert 14 bears the shape of a wedge which is capable of receiving the teeth of the bucket 34. It is preferably wielded inside of pipe 12.

To increase the structural integrity of the pipe 12 after the opening 20 is cut, the steel cut-out that results is then wielded either directly above the opening or directly below the opening as a reinforcement plate 22.

Pipe 12 is supported on its front surface by front pipe braces 18. Front pipe braces 18 are preferably made of grade A120 steel. They preferably measure 1.75 inches in width, 2 inches in height, and 11.5 inches in length. Pipe braces 18 are wielded to the top surface of the tines 24 and the front surface of pipe 12 at a 45 degree angle. On the back surface of pipe 12 are the back pipe braces 16. They are cylindrical in shape and preferably are 4 inches in length and have a diameter of 3 inches. Back pipe braces 16 are wielded to the back surface of pipe 12 and to the top surface of the tines 24.

To connect the track hoe attachment 10 to the track hoe, the teeth of the bucket 34 of the track hoe is inserted into and received by the insert 14 of pipe 12. A chain 36 is then threaded through eyelet 32 of the support bar 30 and the eyelet of the bucket 34. The chain 36 is tightened such that the teeth of the bucket cannot be removed from the insert 14 of pipe 22. The chain 36 preferably has a rating of 8,500 pounds or more. Once the attachment 10 is connected to the bucket 34 of the track hoe, the material being transported can be loaded. The pipes 38 that are being loaded and unloaded rest on tines 24. Stop bars 26 prevent the pipes 38 from moving down the tines 24.

What is claimed is:

1. A track hoe attachment comprising:

(a) a first tine and a second tine, wherein each of said first tine and said second tine has a first end and a second end;

(b) a pipe with a front surface and a back surface, wherein said pipe is connected at said first end of said first tine and at said first end of said second tine, wherein said pipe comprises an opening in said front surface of said pipe;

(c) a support bar with a first end and a second end, wherein said support bar is connected between said first tine and said second tine; and (d) a track hoe bucket, wherein said track hoe bucket is positioned between said pipe and said support bar when said track hoe bucket is engaged in said opening in said pipe.

2. The track hoe attachment of claim 1 wherein said opening of said pipe is configured to receive an insert.

3. The track hoe attachment of claim 2 wherein said insert is wedge shaped.

4. The track hoe attachment of claim 1 wherein said support bar has a first eyelet in said first end of said support bar and a second eyelet in said second end of said support bar.

5. The track hoe attachment of claim 4 wherein said first eyelet and said second eyelet in said support bar are configured to receive a chain.

6. The track hoe attachment of claim 1 further comprising a first stop bar extending vertically from said first tine and a second stop bar extending vertically from said second tine.

7. The track hoe attachment of claim 6 wherein a first stop bar brace is connected to said first stop bar and said first tine, and a second stop bar brace is connected to said second stop bar and said second tine.

8. The track hoe attachment of claim 1 wherein a first front pipe brace is connected between said first tine and said front surface of said pipe, and a second front pipe brace is connected between said second tine and said front surface of said pipe.

9. The track hoe attachment of claim 1 wherein a first back pipe brace is connected between said first tine and said back surface of said pipe, and a second back pipe is connected between said second tine and said back surface of said pipe.

* * * * *